US006976581B2

(12) United States Patent
Chen

(10) Patent No.: US 6,976,581 B2
(45) Date of Patent: Dec. 20, 2005

(54) TOOL BOX HAVING A RATCHET TOOL TEST BASE

(76) Inventor: Terence Chen, No. 325, Yungching Rd., Dungshan Shiang, Ilan (TW)

( * ) Notice: Subject to any disclaimer, the term of this patent is extended or adjusted under 35 U.S.C. 154(b) by 504 days.

(21) Appl. No.: 10/200,320

(22) Filed: Jul. 23, 2002

(65) Prior Publication Data

US 2004/0016667 A1 Jan. 29, 2004

(51) Int. Cl.[7] ..... B65D 85/28
(52) U.S. Cl. ..... 206/373; 206/493
(58) Field of Search ..... 206/373, 376, 206/372, 377, 378, 379, 477, 478, 483, 493

(56) References Cited

U.S. PATENT DOCUMENTS 4,883,174 A * 11/1989 Reeside ..... 206/378
5,071,004 A * 12/1991 Rivera ..... 206/373
5,931,299 A * 8/1999 Hsieh ..... 206/376
6,126,004 A * 10/2000 Ling ..... 206/377
6,257,409 B1 * 7/2001 Lin ..... 206/376

* cited by examiner

*Primary Examiner*—Shian T. Luong
(74) *Attorney, Agent, or Firm*—Rosenberg, Klein & Lee

(57) ABSTRACT

A tool box includes a plurality of hooks and a plurality of clamping members extending from a surface of the tool box. The hooks and the clamping members are located in alignment with each other so that shanks of the tool is clamped by the clamping members and the function end is engaged with the hooks. A test device is connected to the surface of the tool box and includes an inclined support member on which an engaging piece is connected for function end of the wrench to engage with. A restriction frame is on the test device and restrain the range of the shank of the tool to swing.

5 Claims, 5 Drawing Sheets

TOOL BOX HAVING A RATCHET TOOL TEST BASE

FIELD OF THE INVENTION

The present invention relates to a tool box having a first part with clamping members for securing shanks of tools and a second part on which a ratchet tool test base is located.

BACKGROUND OF THE INVENTION

A conventional tool box generally includes a base and a cover and each of the two parts has multiple recesses so that tools are securely engaged with the recesses. An inherent shortcoming is that the user has to insert his or her finger in the narrow space to pull the tool from the recess. There has no proper engaging device to fix the tools with long shank such as a wrench. Only the shank can be clamped by the recess and the function end of the wrench is not secured. Another tool box has a test device that is used for testing the ratchet mechanism of the function end and the shank of the wrench can be swung within a certain range of angles. The test device has a fixed protrusion for the function end to be mounted thereto and the function end of wrenches has different angles so that when rotating the tool, the fixed protrusion could be broken.

The present invention intends to provide a tool box that has clamping members for clamping shanks of the tools and hooks for securing the function ends. A test device has an adjustable base so that the heads of tools with different angles can be used on the test device.

SUMMARY OF THE INVENTION

In accordance with one aspect of the present invention, there is provided a tool box which includes a plurality of hooks and a plurality of clamping members extending from a surface of the tool box. The hooks and the clamping members are located in alignment with each other so as to securely position the tools in the tool box. A test device is connected to the surface of the tool box for testing the ratchet mechanism of the ratchet tools.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
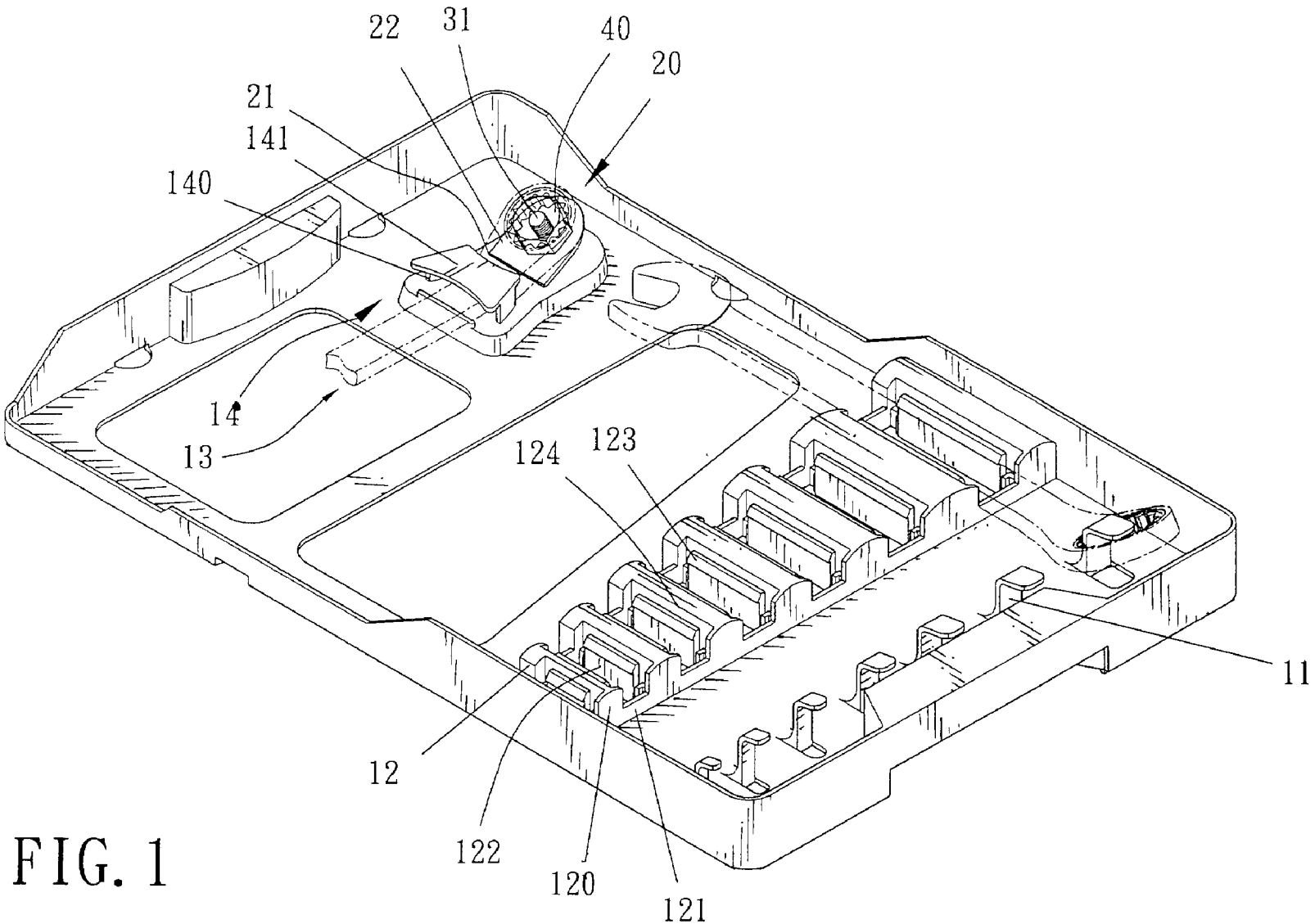
FIG. 1 is a perspective view to show the tool box of the present invention.
Figure 2:
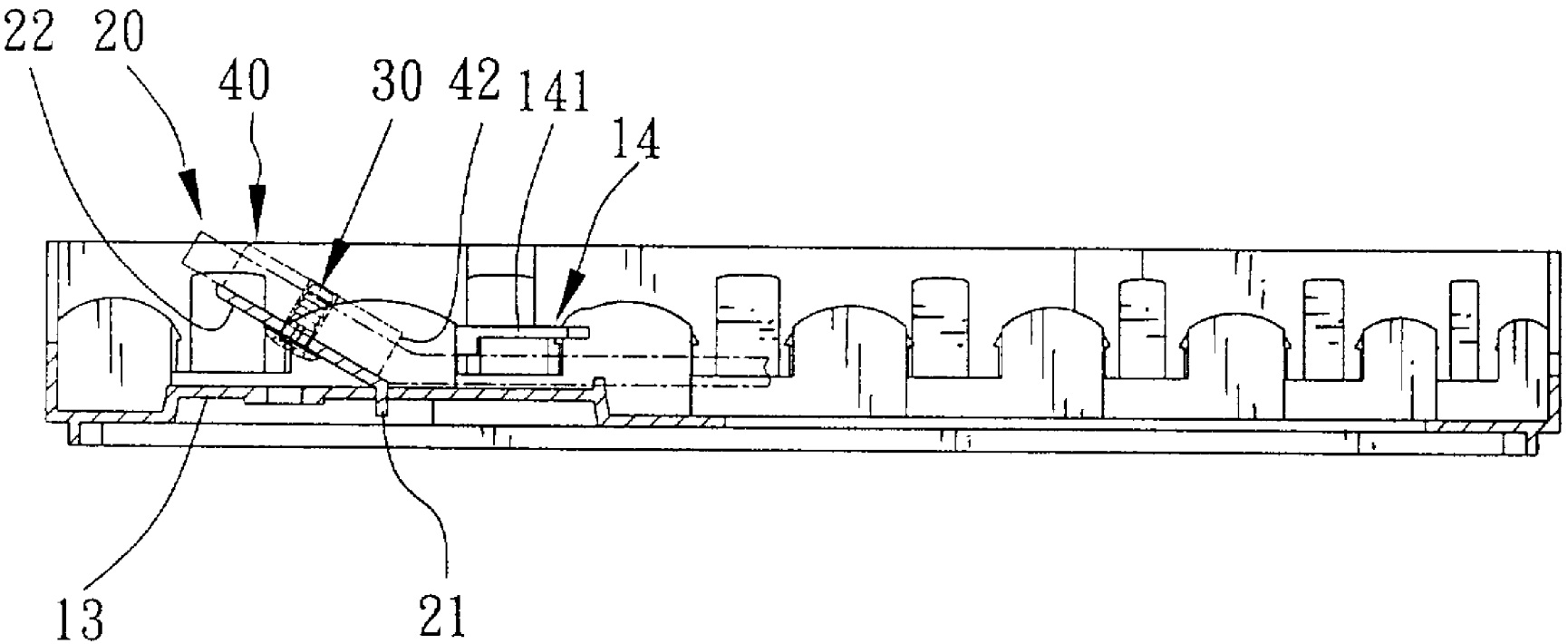
FIG. 2 is a side view to show the arrangement of the test device and clamping members in the tool box.
Figure 3:
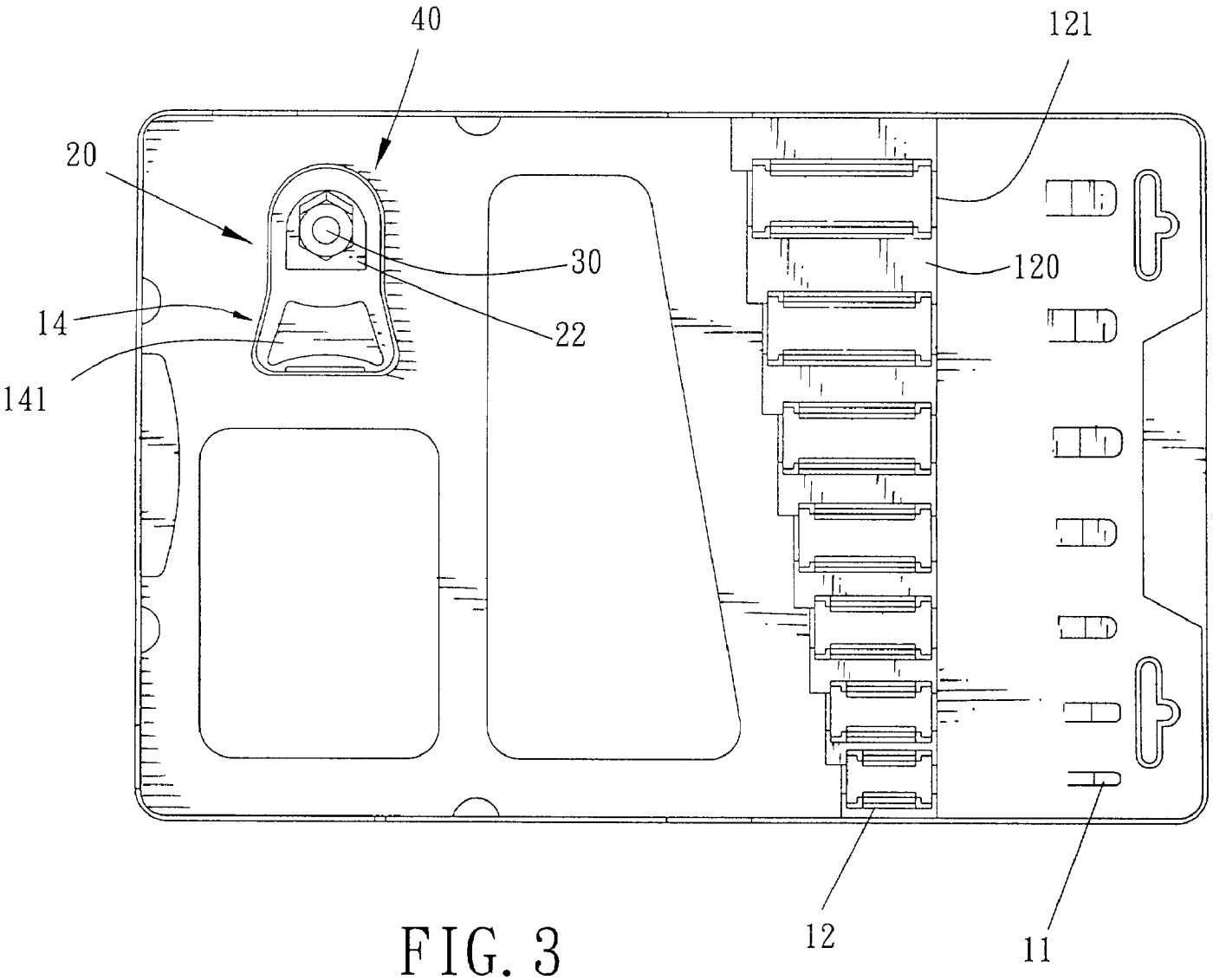
FIG. 3 is a top view to show the tool box of the present invention.
Figure 4:
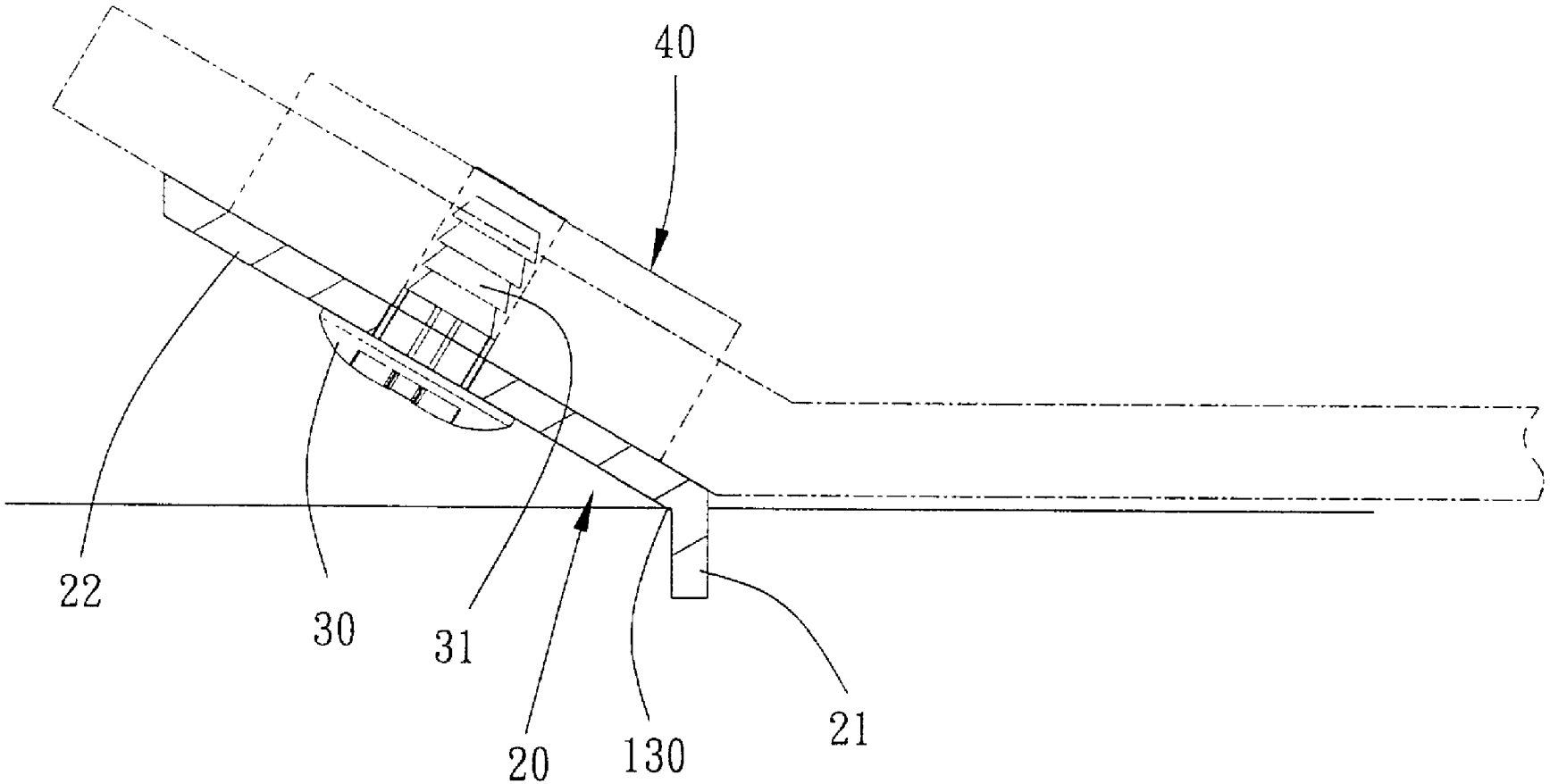
FIG. 4 shows the inclined support member and the engaging piece for being engaged with a tool.

Referring to FIGS. 1 to 4, the tool box of the present invention comprises a plurality of L-shaped hooks 11 and a plurality of clamping members 12 extending from a surface of the tool box. The hooks 11 and the clamping members 12 are located in pairs and in alignment with each other such that the tool such as wrenches can be clamped by the clamping members 12. Each of the clamping members 12 includes separation pieces 120 extending from the surface of the tool box and recesses 121 are defined between the separation pieces 120. Two clamping plates 122 are located in each of the recesses 121 and each clamping plate 122 has a retaining ridge 123 on a top thereof. A gap 124 is defined between an inside of each of the separation pieces 120 and the clamping plates 122. A shank of the wrench is clamped by the two clamping plates 122 and the retaining ridges 123 position the shank in the recess. The function end of the wrench such as the box-end is engaged with the hook 11 so that the wrench does not slip.

A test device 13 is connected to the surface of the tool box and a restriction frame 14 is connected thereto. The restriction frame 14 has a top plate 141 and two side walls 140 extend from an underside of the top plate 141 and are connected to the test device 13. An inclined support member 20 is connected to the test device 13 and includes an insertion 21 which is connected to the test device 13 and a support plate 22 extends from the insertion 21 inclinedly. A positioning member 30 has a teethed engaging portion 31 which extends through a center of the support plate 22 and an engaging piece 40 such as a polygonal nut is connected to the engaging portion 31.

Figure 5:
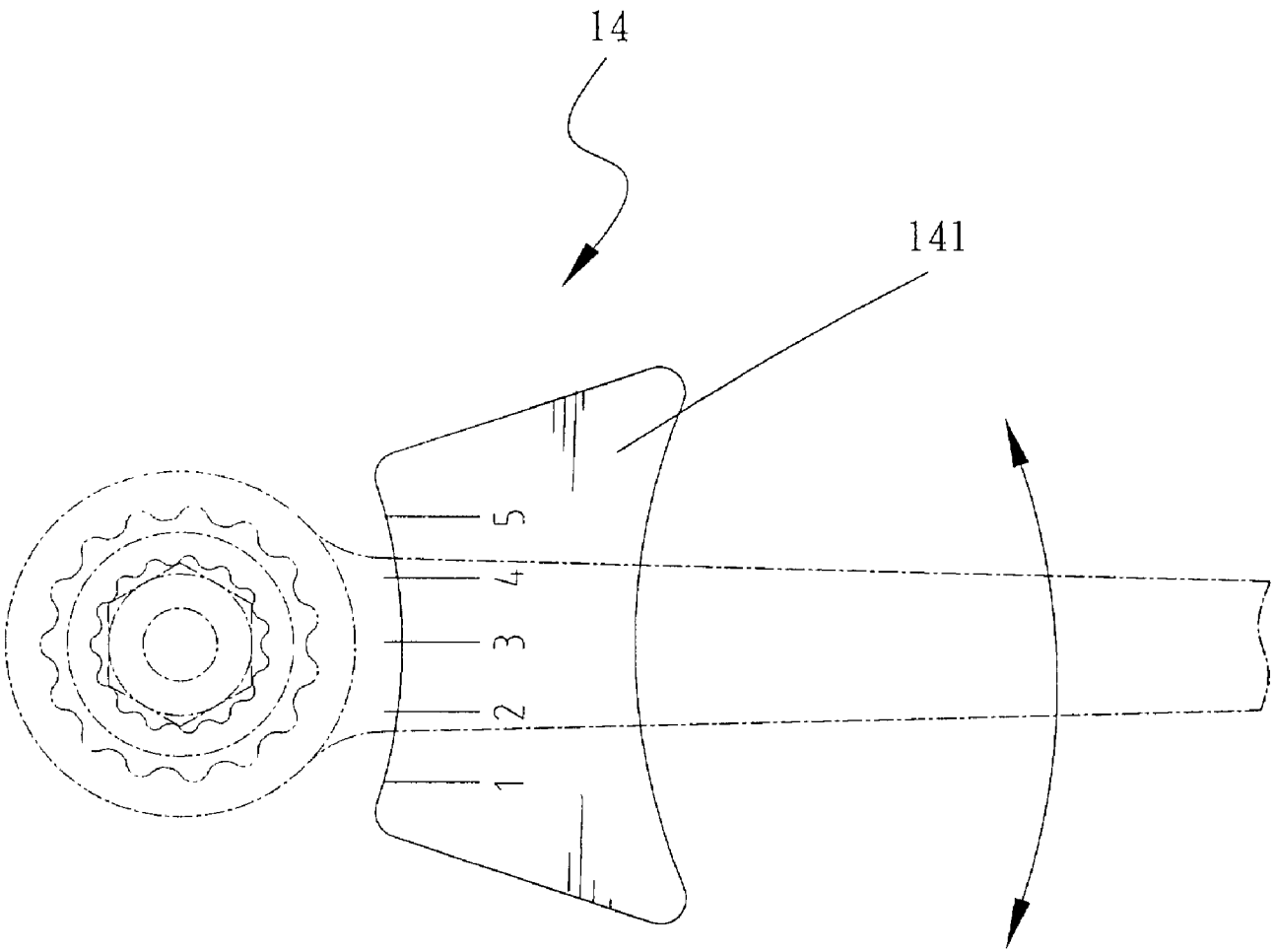
FIG. 5 shows the restriction frame and a shank of a tool is restricted by the restriction frame.

Further referring to FIG. 5, the shank of the wrench extends through the passage defined between the top plate 141 and the two side walls 140 of the restriction frame 14 and the function end having a ratchet mechanism (not shown) is mounted to the engaging piece 40. The shank is able to be swung a limited angle between the two side walls 140 to test the function of the ratchet mechanism.

While we have shown and described the embodiment in accordance with the present invention, it should be clear to those skilled in the art that further embodiments may be made without departing from the scope of the present invention.

What is claimed is:

1. A tool box comprising:

a plurality of hooks and a plurality of clamping members extending from a surface of the tool box, the hooks and the clamping members being located in alignment with each other, and a test device connected to the surface of the tool box and includes an inclined support member and an insertion member, said insertion member further including a restriction frame having a top plate and two side walls extending from an underside of said top plate, said test device being removably received and securely held within a slot defined by said top plate.

2. The tool box as claimed in claim 1, wherein the inclined support member comprises an insertion connected to the test device and a support plate extends from the insertion inclinedly, a positioning member connected to the support plate.

3. The tool box as claimed in claim 4, wherein the positioning member extends through a center of the support plate and includes engaging portion which is engaged with an engaging piece which is adapted to be engaged with a wrench.

4. A tool box comprising:

a plurality of hooks and a plurality of clamping members extending from a surface of the tool box, the hooks and the clamping members being located in alignment with each other, and a test device connected to the surface of the tool box and includes an inclined support member, said inclined support member comprising an insertion connected to the test device and a support plate extending from the insertion inclinedly, a positioning member being connected to the support plate, said test device further including a restriction frame having a top plate and two side walls extending from an underside of said top plate, said insertion being removably received and securely held within a slot defined by said top plate.

5. The tool box as claimed in claim 4, wherein the positioning member extends through a center of the support plate and includes an engaging portion which is engaged with an engaging piece which is adapted to be engaged with a wrench.

* * * * *